US005300761A

United States Patent [19]

Kasahara et al.

[11] Patent Number: 5,300,761

[45] Date of Patent: Apr. 5, 1994

[54] IMAGE FORMING APPARATUS COUNTING SYSTEM USING INDIVIDUAL AND COLLECTIVE COUNTERS

[75] Inventors: Seitaro Kasahara; Minoru Asakawa; Yasunori Ohgo, all of Hachioji, Japan

[73] Assignee: Konica Corporation, Tokyo, Japan

[21] Appl. No.: 831,367

[22] Filed: Feb. 4, 1992

[30] Foreign Application Priority Data

Feb. 15, 1991 [JP] Japan ..... 3-022179

[51] Int. Cl.[5] ..... G03G 15/00

[52] U.S. Cl. ..... 235/375; 355/201

[58] Field of Search ..... 235/375; 355/201

[56] References Cited

U.S. PATENT DOCUMENTS

| | | | |
|---|---|---|---|
| 3,997,873 | 12/1976 | Thorton | 355/201 |
| 4,501,485 | 2/1985 | Tsudaka | 235/375 |
| 4,531,826 | 7/1985 | Stoughton et al. | 355/201 |
| 5,124,754 | 6/1992 | Higaki | 355/201 |

FOREIGN PATENT DOCUMENTS

| | | |
|---|---|---|
| 60-165664 | 8/1985 | Japan . |
| 61-277976 | 12/1986 | Japan . |
| 62-96958 | 5/1987 | Japan . |
| 62-96966 | 5/1987 | Japan . |
| 1-105964 | 4/1989 | Japan . |

*Primary Examiner*—John Shepperd

*Attorney, Agent, or Firm*—Frishauf, Holtz, Goodman & Woodward

[57] ABSTRACT

A counting device for counting a number of image forming operations of an image forming apparatus. The counting device includes a registering device for registering a plurality of identification codes and a comparing device for comparing an identification code stored in a portable memory card with the plurality of identification codes registered in the registering device. A first memory counter counts a number of image forming operations of the image forming apparatus when the comparing device matches the identification code stored in the portable memory card with at least one of the plurality of identification codes registered in the registering device. A second memory counter counts a number of image forming operations of the image forming apparatus when the comparing device does not match the identification code stored in the portable memory card with any of the plurality of identification codes registered in the registering device. Thus, the number of copying operations can be both collectively and individually counted.

3 Claims, 18 Drawing Sheets

IMAGE FORMING APPARATUS COUNTING SYSTEM USING INDIVIDUAL AND COLLECTIVE COUNTERS

BACKGROUND OF THE INVENTION

The present invention relates to an image forming apparatus such as an electrophotographic copying machine or the like, and particularly to an image forming apparatus that can become ready for operation and become capable of being controlled when a memory means such as a memory card that is detachable and portable is mounted on the apparatus main body.

An image forming apparatus such as a copying apparatus has recently come into wide use, and it has shown remarkable advancement in terms of performance and function. Such a copying apparatus with high function is controlled to be used by plural departments in a company for common use in many cases, which is different from a simplified copying apparatus for personal use. In this case, the proper way for each department to bear the administrative expenses for the copying apparatus is to pay depending on the number of copies the department made using the copying apparatus. For this reason, memory cards (portable memory means) which are detachable and portable and carry registered codes of each department or personnel have been assigned to each department so that each memory card may be mounted on the apparatus main body when copying. Thus, the number of copies made by each department has been managed properly. Many copying apparatuses capable of accepting a memory card have been proposed. For example, Japanese Patent O.P.I. Publication Nos. 165664/1985, 277976/1986, 96958/1987, 96966/1987 and 105964/1964 disclose technologies related to the foregoing.

With regard to a memory card having highly advanced functions which can be attached to or detached from an image forming apparatus, an ID number (hereinafter referred to as an ID No.) such as a given number is usually stored in each memory card as a card ID No., while in the image forming apparatus, there are registered a plurality of card ID Nos. which can use the image forming apparatus. When these card ID Nos. agree with usable card ID Nos. stored in the memory card, it is possible to form images, and each time an image is formed, it is counted on a predetermined memory (a count memory means) corresponding to a usable card ID No., resulting in control of the number of image forming operations.

However, when each usable card ID No. is provided with a count memory means described above, many count memory means are required. In addition to that, the number of cards used frequently on the same image forming apparatus is not so large, and consequently, it is of no use from a viewpoint of centralized control to provide a count memory means on a card that is hardly used.

An object of the invention therefore is to provide an image forming apparatus wherein the number of image forming operations through cards which are hardly used can be controlled collectively for eliminating uselessness, in the case of centralized control of the number of image forming operations.

SUMMARY OF THE INVENTION

The aforementioned object can be achieved by an image forming apparatus comprising a portable memory means wherein "card ID number" is stored in advance, a count memory unit that compares the "card ID No." stored in the aforementioned portable memory means with plural "usable card ID Nos." which are registered beforehand, and stores the number of frequency of image forming operations for each "card ID No." when the aforementioned "card ID No." agrees with the aforementioned "usable ID No.", and a count memory unit that stores the number of image forming operations collectively when the aforementioned "card ID No." does not agree with the aforementioned "usable card ID number".

DETAILED DESCRIPTION OF THE INVENTION

Figure 1:
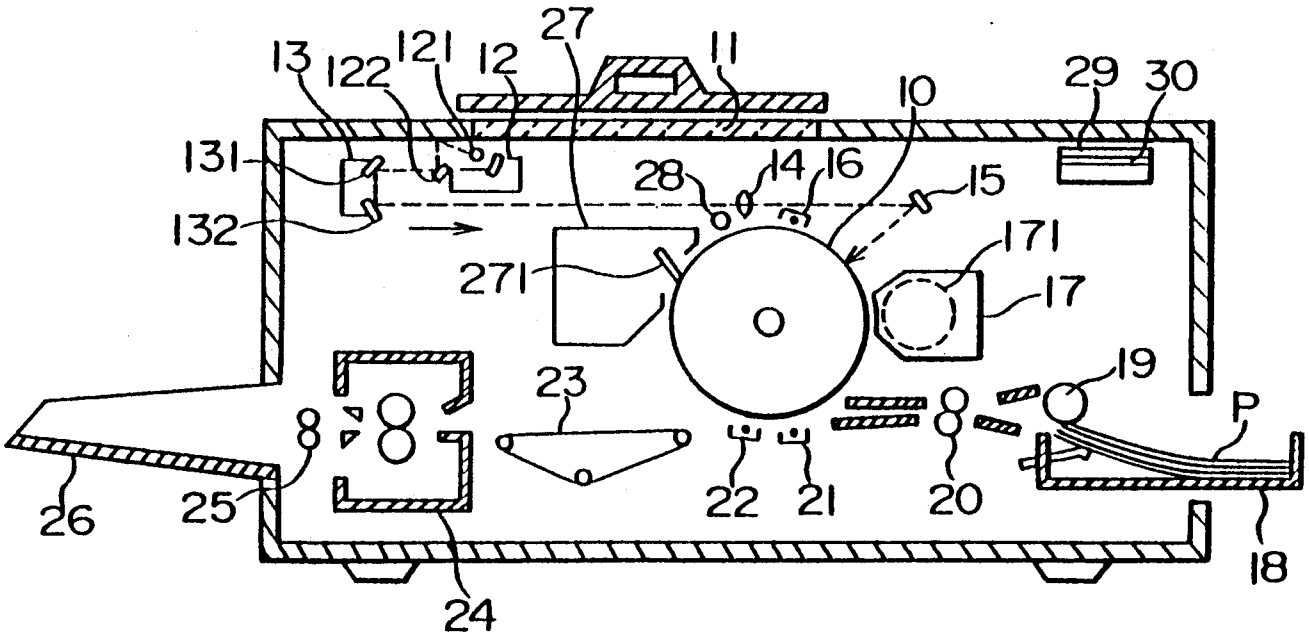
FIG. 1 is a sectional view of a primary structure of an image forming apparatus related to the invention.

The present invention will be explained as follows, referring to the drawings. FIG. 1 is a sectional view of a primary structure of a copying machine that is an example of an image forming apparatus of the invention.

The copying process of the copying machine will first be briefly explained. Photoreceptor drum 10 on which a light-sensitive layer is provided through the method of coating or evaporation is driven by an unillustrated driving means and rotates clockwise, during which the photoreceptor drum 10 is cleaned by cleaning means 27 (which will be described later) so that residual toner staying on the photoreceptor drum 10 may be removed and pre-charging exposure lamp 28 is lit to remove residual charges which are staying locally on the surface of the photoreceptor drum 10. Then, the light-sensitive layer of the photoreceptor drum 10 is charged evenly by charging unit 16.

On the other hand, halogen lamp 121 affixed on carriage 12 that travels horizontally irradiates a document placed on platen 11, being synchronized with the rotation of the photoreceptor drum 10. Reflected light from the document originated from the halogen lamp 121 forms an image on the photoreceptor drum 10 which will be described later through a slit (not shown), mirror 122, mirrors 131 and 132 on movable mirror unit 13, lens 14 and mirror 15. Namely, the photoreceptor drum 10 is exposed to the reflected light from the document and thereby an electrostatic latent image is formed on the photoreceptor drum 10.

Incidentally, the aforementioned carriage and movable mirror unit 13 are driven through wires (neither is shown) connected to a stepping motor and slide in the same direction at the speed of V and the speed of ½ V respectively.

The electrostatic latent image is developed by developing unit 17 containing toner and a toner image is formed on the photoreceptor drum 10. On developing sleeve 171 of the developing unit 17, is impressed DC or AC bias, and reversal development is carried out on the photoreceptor drum 10 whose base frame is grounded.

The toner image formed on the photoreceptor drum 10 is transferred onto transfer material P that is fed out by sheet-feeding roller 19 from sheet-feeding cassette 18 and is synchronized with the aforementioned toner image by timing roller 20. The transferring is carried out by transfer unit 21 that impresses power of high voltage whose polarity is opposite to that of toner.

The transfer material P on which a toner image has been transferred as described above is surely separated by separation electrode 22 from the surface of the photoreceptor drum 10, and then conveyed to fixing means 24 by conveyance belt 23. Then, the transfer material P, after the toner image on the transfer material P has been melted and fixed by the fixing means 24, is ejected by sheet discharge roller 25 onto sheet delivery tray 26 provided outside of the apparatus.

On the other hand, the photoreceptor drum 10 from which the toner image has been transferred onto the transfer material P further rotates clockwise and is cleaned by the cleaning means 27 having cleaning blade 171 that is kept in pressure-contact with the surface of the photoreceptor drum 10 to be free from residual toner thereon. After the cleaning has been completed, next copying process is started.

Figure 2:
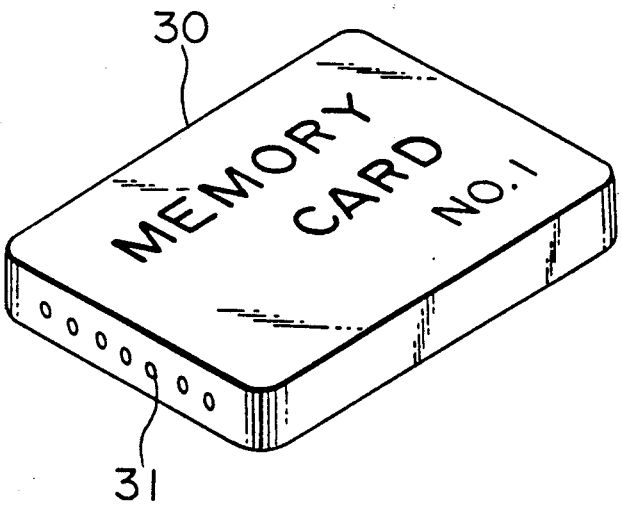
FIG. 2 is a perspective view showing a card which is a portable memory means related to the invention.

FIG. 2 is a perspective view showing card 30 that is a portable memory means related to the invention. The card 30 can be attached to or detached from an image forming apparatus and comprises a memory means capable of being carried by an operator, such as, for example, memory card 30 (hereinafter abbreviated as a card) having non-volatile memory such as a memory card or an IC card. A plurality of the cards may be prepared for one image forming apparatus, or one card or plural cards may be prepared for plural image forming apparatuses, and thus a card may assigned to each department or each person to be used. The card 30 is inserted through a slot (not shown) for card 30 provided on the enclosure in the vicinity of an operation panel of the image forming apparatus, and is attached to acceptor 29. When the card 30 is attached to the acceptor 29, (shown in FIG. 1) input/output connector 31 provided on the card 30 and a connector (not shown) of second control means 50 (which will be described later) are connected electrically so that signals may be transmitted in both ways. With regard to the contents to be stored in the card 30, card ID No. for confirmation of the card 30 (assigned to each department in the present example), plural image forming apparatuses ID Nos. which can be used with the card 30, and ID No. corresponding to each person can be stored in ID No. memory means 32, and as one for centralized control use, the number of copying operations connducted with the card 30, the number of frequency of copying operation made by each person and the number operations by size of transfer material can be stored in counter memory means 34. Incidentally, when the aforementioned image forming apparatus is a color image forming apparatus, image forming modes, namely the sequence program of image forming process control which is specific for each of monochromatic image forming, monochromatic image forming and full-color image forming may be stored.

Figure 3:
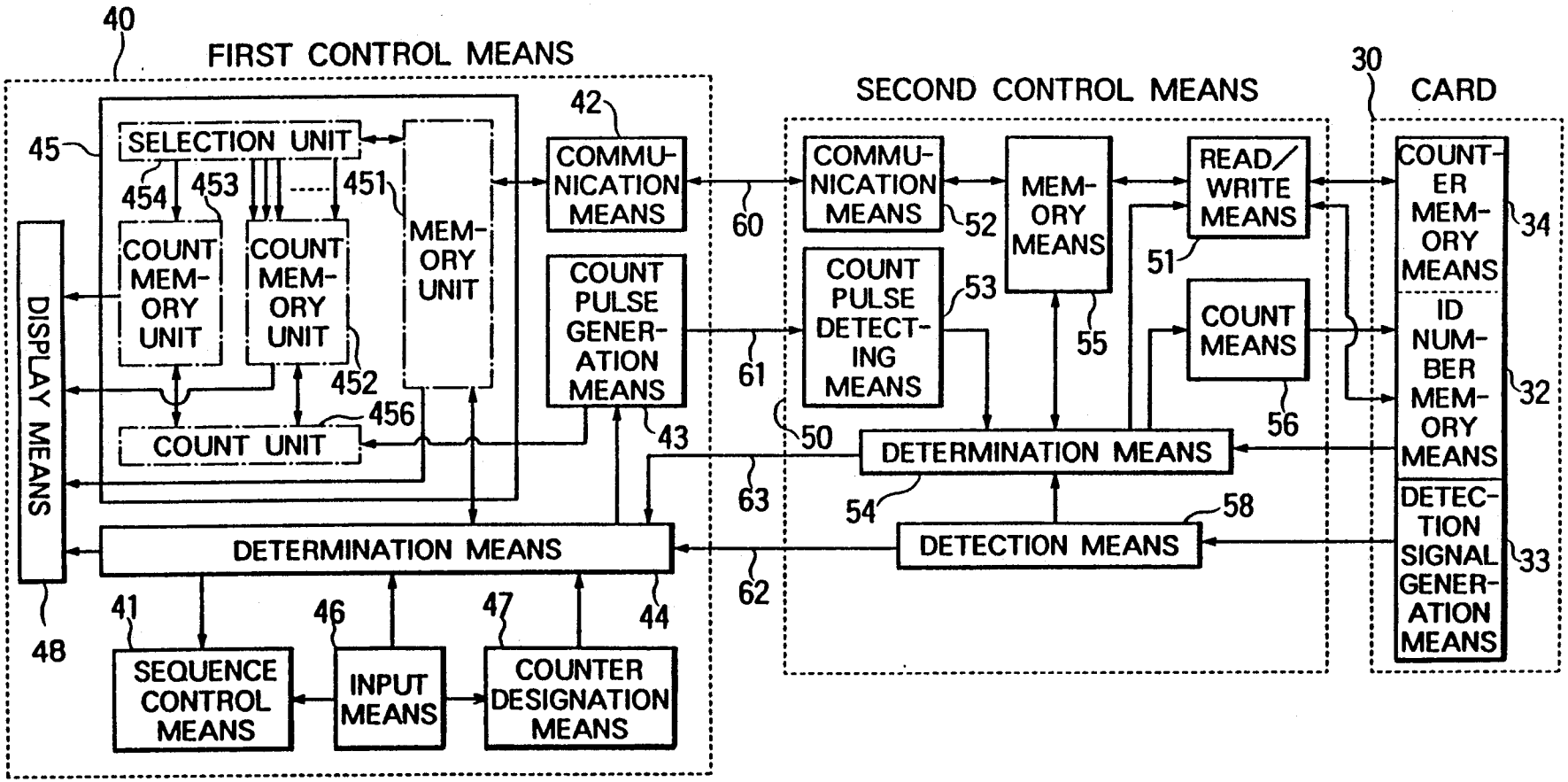
FIG. 3 is a block diagram 1 showing the controlling system in the invention, FIGS. 4(*a*)–4(*c*) represents a transmission circuit diagram for communication and count pulses and a time chart for sending and receiving, and, FIG. 5 is a block diagram related to card confirmation.

FIG. 3 is a block diagram showing the controlling system in an image forming apparatus of the invention. In the image forming apparatus, there are provided the first control means 40 and the second control means 50, and the aforementioned card 30 can be attached to or detached from the second control means 50.

The first control means 40 has therein sequence control means 41 that performs the aforementioned process control, communication means 42 that communicates with the second control means, count pulse generation means 43 that generates pulses corresponding to the number of frequency of image forming, determination means 44 that performs various determination, memory means 45 that stores ID No. of an image forming apparatus, ID No. such as ID No. of usable card 30, the number of copying operations corresponding to usable card ID No. and the number of copying operations for cards other than the aforementioned usable card ID No., input means 46 in which the setting of various image forming process modes and registration of ID No. may be stored, counter designation means 47 that designates counter that counts, and display means 48 that indicates various displays on displays (none of them is shown) on the operation panel.

On the other hand, the second control means 50 provided on the acceptor for the card 30 has therein read/write means 51 that reads or writes information on the aforementioned card, communication means 52 that communicates with the first control means, count pulse detection means 53 that detects count pulses generated from the aforementioned count pulse generation means 43, determination means 54 that performs various determinations, memory means 55 that stores information obtained by the communication means 52, count means 56 that counts to counter memory means 34 for card 30, detection means 58 that detects that the card 30 has been attached to the acceptor 29, and a connector portion that can be connected electrically to connector 31.

Namely, by means of providing the first control means 40 that mainly controls the process sequence at an optimum position inside an image forming apparatus, and by providing the second control means 50 that mainly controls reading and writing of card 30 on the card acceptor 29, the restriction in terms of space may be reduced substantially.

The communication means 42 of the first control means 40 is connected to the communication means 52 of the second control means 50 by the serial communication transmission means 60, the count pulse generation means 43 of the first control means 40 is connected to the count pulse detection means 53 of the second control means 50 by the count pulse transmission means 61, the determination means 44 of the first control means 40 is connected to the detection means 58 of the second control means 50 by the card IN transmission means 62, and the determination means 44 of the first control means 40 is connected to the determination means of the second control means 50 by the card invalidation transmission means 63.

Figure 4:
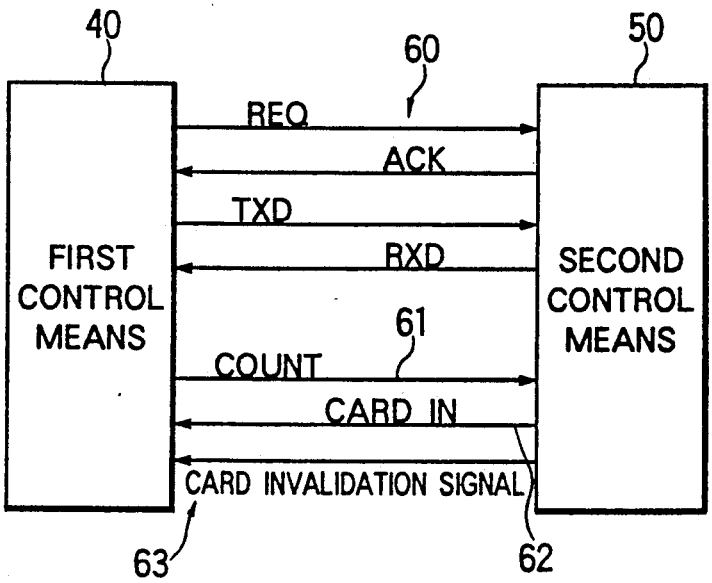
Figure 4:
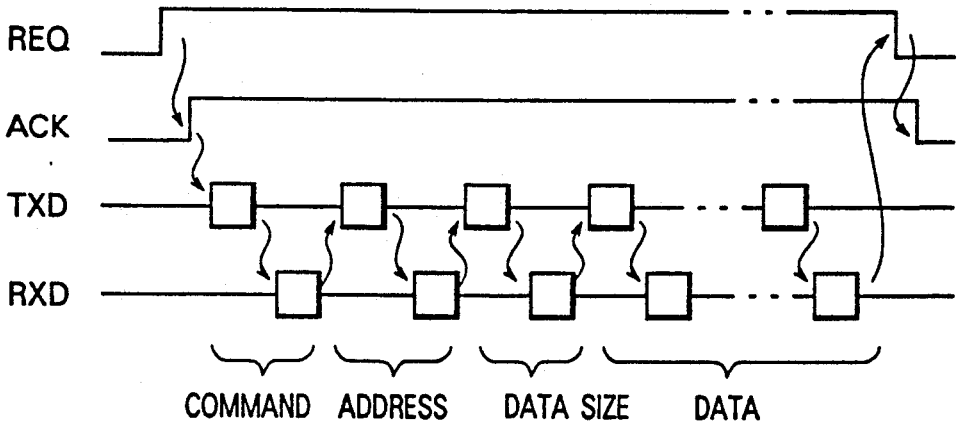
Figure 4:
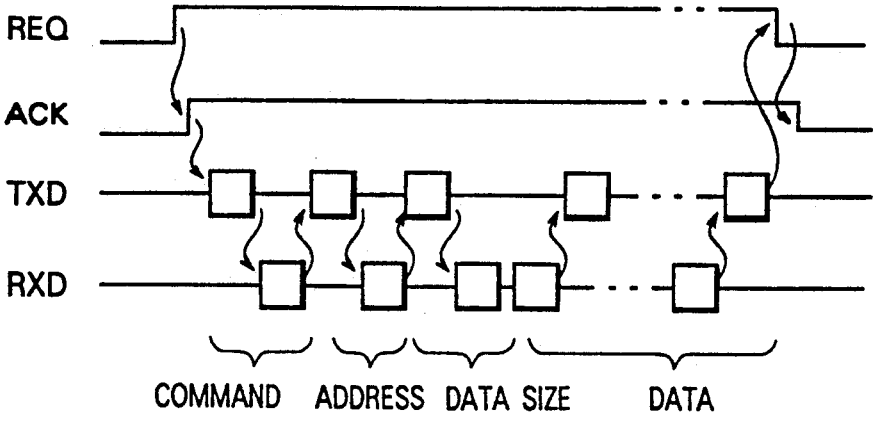

FIG. 4 (*a*) shows the details of the communication transmission means 60 and the count pulse transmission means 61. The communication transmission means 60 is composed of four lines, and transmission from the first control means 40 to the second control means 50 is conducted through both REQ line and TXD line, and transmission from the second control means 50 to the first control means 40 is conducted through both ACK line and RXD line, both based on a communication format of a data length of 8 bits. Data to be transmitted can be checked in terms of an error through correspondence on a repetition basis and data free of error can be confirmed when there is no difference between the repeated transmission and the original transmission.

FIG. 4 (*b*) represents a time chart for sending data from the first control means 40 to the second control means 50, and transmission is conducted in the order of a command, a peak address, byte number and data. The data are stored in the memory means 55 in the second control means 50 provisionally, and when no error is observed, writing on the card 30 is conducted. FIG. 4 (*c*) represents a time chart for the transfer of the data of the card 30 to the first control means 40, and writing is similar to that in (*b*), but data are transferred from the card 30 previously.

On the count pulse transmission means 61, there is provided a COUNT line for transferring the count signals in a pulse waveform from the first control means 40 to the second control means 50, and count signals are detected by the pulse detection means 53 provided in the second control means 50. The card IN transmission means 62 is provided with card IN line that sends card IN signals when detection means 58 detects that the card 30 has been attached to the acceptor 29, and that transfers the card IN signals from the detection means 58 of the second control means 50 to the first control means 40, and the card IN signals are detected by the determination means 44 provided in the first control means 40. The card invalidation transmission means 63 is provided with a card invalidation line that transfers card invalidation signals which will be described later from the determination means 54 of the second control means 50 to the first control means 40, and the card invalidation signals are detected by the determination means 44 provided in the first control means 40.

Namely, for transmission of signals having less information such as count signals, card IN signals and card invalidation signals, exclusive count pulse transmission means 61, card IN transmission means 62 and card invalidation transmission means 63 are provided for transmission without depending on the aforementioned communication transmission means 60. Thus, a transmission time for each of them is shortened for good response and even a simple program can control.

Figure 5:
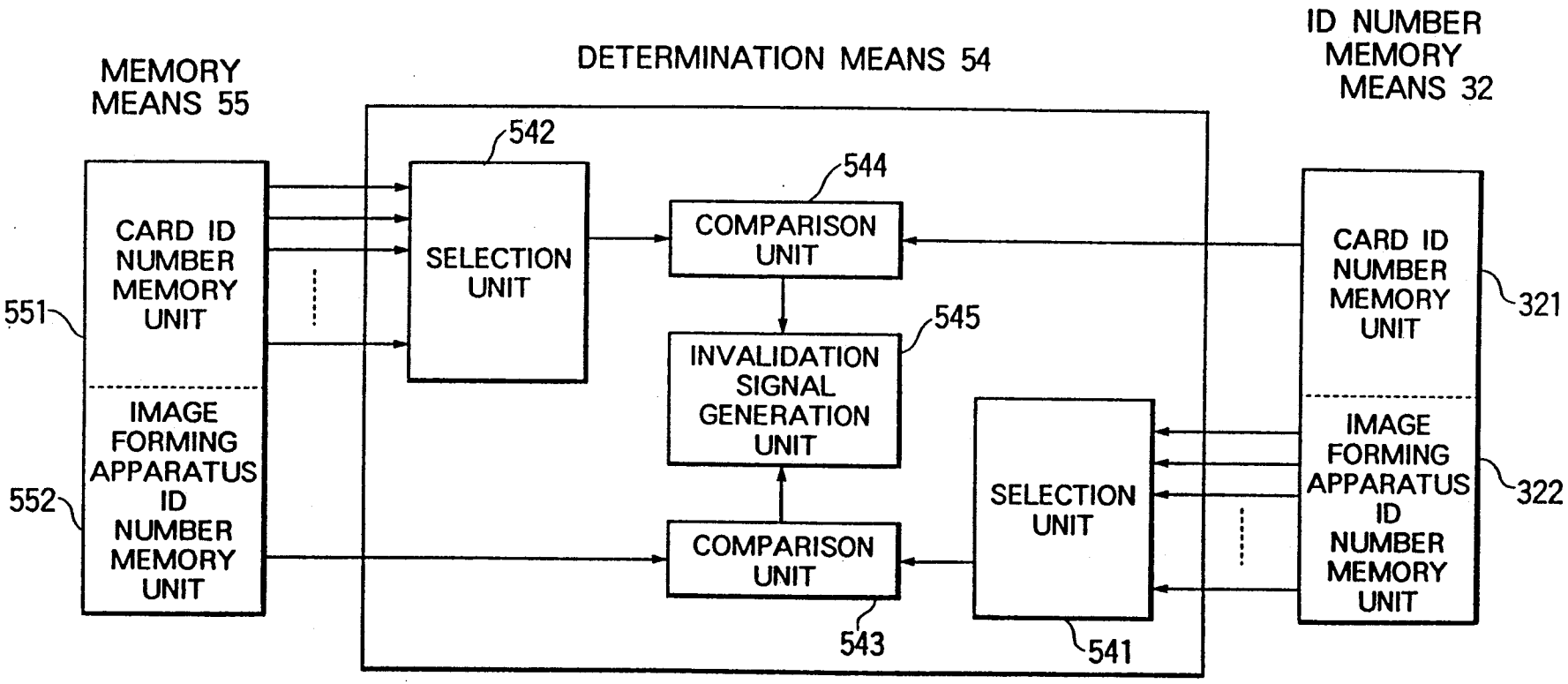

The sending of aforementioned card invalidation signals will be described, referring to FIG. 5 which that is a detailed block diagram for card 30 confirmation. As described before, for confirmation of it, the card 30 is confirmed whether the card 30 is valid or invalid based on ID No. stored in memory means 32 for storing the ID No. of the card 30 (which will be explained in detail in the steps B18, B19, B24, and B25 in the flowchart described in the latter stage). Memory means 32 for storing the ID No. of card 30 is composed of memory unit 321 for card ID No. which stores card ID No. (given ID No. assigned to card 30 itself), memory unit 322 for image forming apparatus ID No. that stores ID No. of an image forming apparatus which can be used with the card 30 (for example, an ID No. corresponding to a serial number of the image forming apparatus or the like, and ID Nos. are usually set on a card so that plural image forming apparatuses may be valid for the card) and others (a memory unit that stores ID No. of each person).

In an image forming apparatus, on the other hand, plural card ID Nos. (given ID Nos. assigned to card 30 itself) with which the image forming apparatus can be used are stored in memory unit 551 for card ID No. provided in the image forming apparatus, while, an image forming apparatus ID No. that is specific to the image forming apparatus (for example, and ID No. corresponding to the serial number of the image forming apparatus) is stored in memory unit 552 for image forming apparatus ID No. provided in the image forming apparatus (which also can store an ID No. of each department of each person). Incidentally, in the present example, an image forming apparatus ID No. stored in the image forming apparatus and usable card ID No. are stored in memory means 45 of the first control means 40 in advance and then transferred (through the step A6 of the flowchart in the latter stage) to the second control means 50 by means of the aforementioned communication means 42 and 52 as well as of communication transmission means 60 to be stored in memory unit 55. However, it is a matter of course that the invention is not limited only to this example, and ID Nos. can be stored in the memory unit 55 of the second control means 50.

When card 30 is attached to acceptor 29 in an image forming apparatus, the card 30 is determined whether it is valid or not by determination means 54 of the second control means 50 (to be more precise, determined through 'card check' in step A7 of the flowchart in the latter stage, and to be more exactly, in steps B18, B19, B24 and B25). The determination means 54 has thereon selection units 541 and 541, comparison units 543 and 544, and invalidation signal generation unit 545 as a means for determining card 30.

With regard to determination of whether card 30 is valid or not, confirmation of ID No. of an image forming apparatus will be explained first. As described, card 30 stores plural ID Nos. of image forming apparatuses which can be used with the card 30, and each of them is selected by selection unit 541. Then, the selected ID No. of the image forming apparatus is compared with the ID No. of an image forming apparatus stored in the memory means 55 and it is determined whether or not they agree with each other by comparison unit 543. When none of ID Nos. of image forming apparatuses stored in the card 30 agrees, invalidation signal generation unit 545 generates invalidation signals which are transferred to the first control means 40 by card invalidation transmission means 63.

With regard to confirmation of card ID Nos, on the other hand, an image forming apparatus stores therein plural card ID Nos. usable on the image forming apparatus as stated above, and selection unit 542 selects them one by one and a card ID No. thus selected is compared with a memory ID No. stored in card 30 by comparison unit 544, and it is determined whether or not it agrees with the memory ID No. When none of card ID Nos. stored in the image forming apparatus agrees, invalidation signal generation unit 545 generates invalidation signals which are transferred to the first control means 40 by card invalidation transmission means 63. In the present example, however, confirmation of card ID No. is carried out by both ,input means 46 provided in the image forming apparatus and setting of confirmation mode for card ID No. for confirmation or non-confirmation by means of a specific switch. When the confirmation mode is not set, card invalidation signals are not generated even when the card ID No. does not agree (steps B21 and B22).

In the image forming apparatus of the invention, designation of each corresponding counter by image forming apparatus ID No., by card ID No. and by person ID No. mentioned above is transmitted (step A6 in the flowchart in the latter stage) from the first control means 40 to the second control means 50 during the non-job period in advance through communication transmission means 60, and memory means 55 in the second control means 50 or card 30 stores the aforementioned count designation. The first control means 40 causes, at a predetermined timing of sequence control, the count pulse generation means 43 to generate count pulses, and causes count pulse transmission means 61 to transmit the pulses to the second control means 50. Count pulse detection means 53 in the second control means 50 detects the count pulses, and the counter in the card 30 is counted by count means 56 based on a designation stored in memory means 55 in the second control means 50 or in the card 30.

On the other hand, memory unit 45 of the first control means 40 comprises of memory unit 451 that stores plural usable card ID Nos., image forming apparatus ID Nos and so forth, count memory unit 452 that stores the number of copying operations corresponding to the card ID No., count memory unit 453 that collectively stores the number of copying operations for card ID Nos. other than the aforementioned card ID No. corresponding to the card ID No., selection unit 454 that selects the aforementioned count memory units 452 and 453, and count unit 456 that counts count memory units 452 and 453 selected by the aforementioned selection unit 454 based on count pulses generated from count pulse generation means 43. Count unit 456 counts, according to generation of count pulses of the aforementioned count pulse generation means 43, to count memory unit 452 that stores the number of copying operations corresponding to the card ID No. selected by selection means 454 based on the card ID No. transferred in the step D12 (which will be described later).

Alternatively to the embodiment comprising the plural memory units 452 and 453, it is possible to configure an embodiment in which the count memory unit 452 is not provided. In such an embodiment, counting of copying operations executed by using both valid ID Nos. and invalid ID Nos. is stored in counting memory unit 453.

In the present example, as described above, the count memory unit 452 has a memory area that stores a count corresponding to the number of copying operations corresponding to usable card ID Nos. stored in memory unit 451, and count memory unit 453 has one memory area. The present invention, however, is not naturally limited to this.

Figure 6:
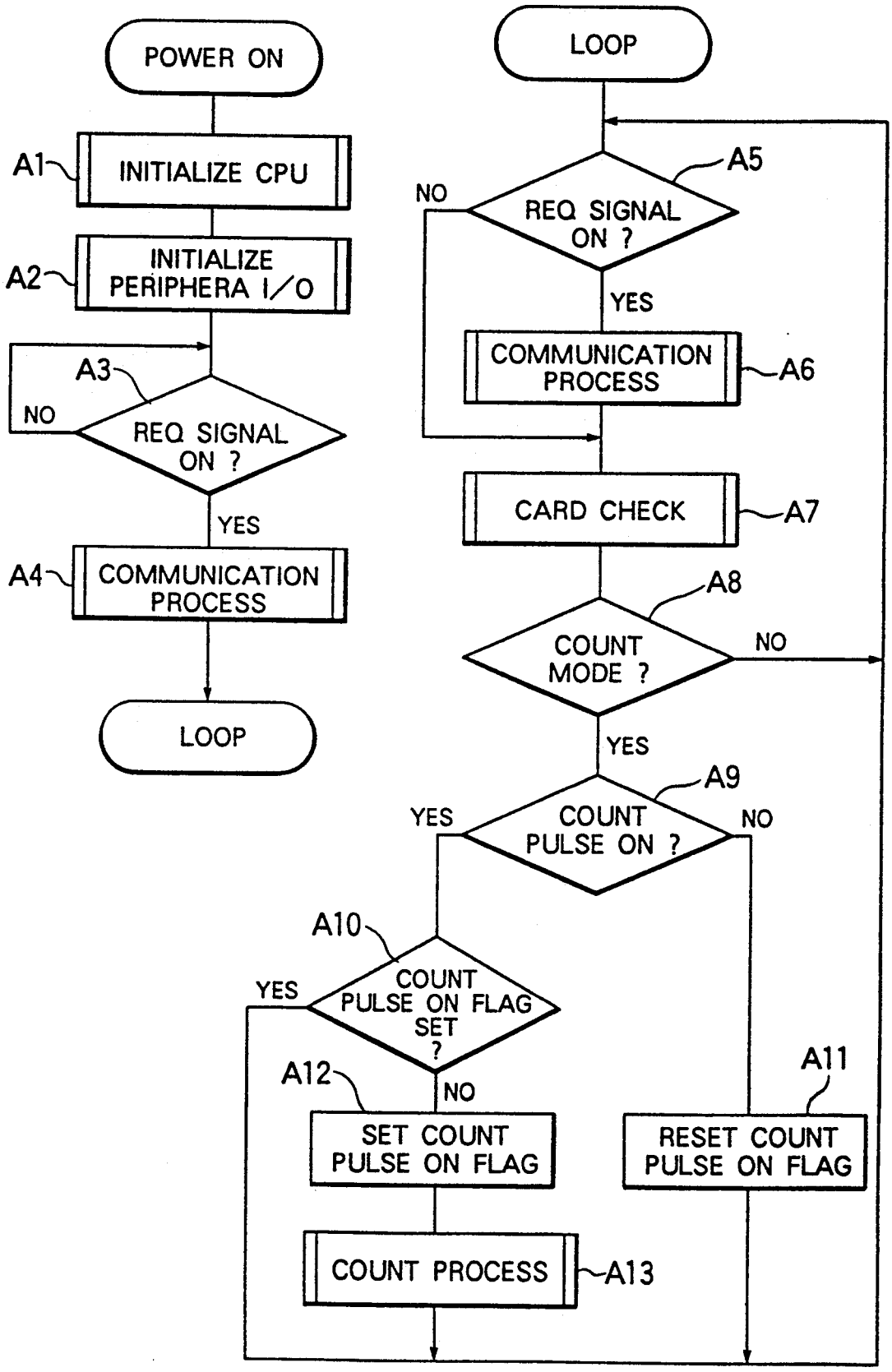
FIG. 6 is a flowchart diagram of the second control means.
Figure 7:
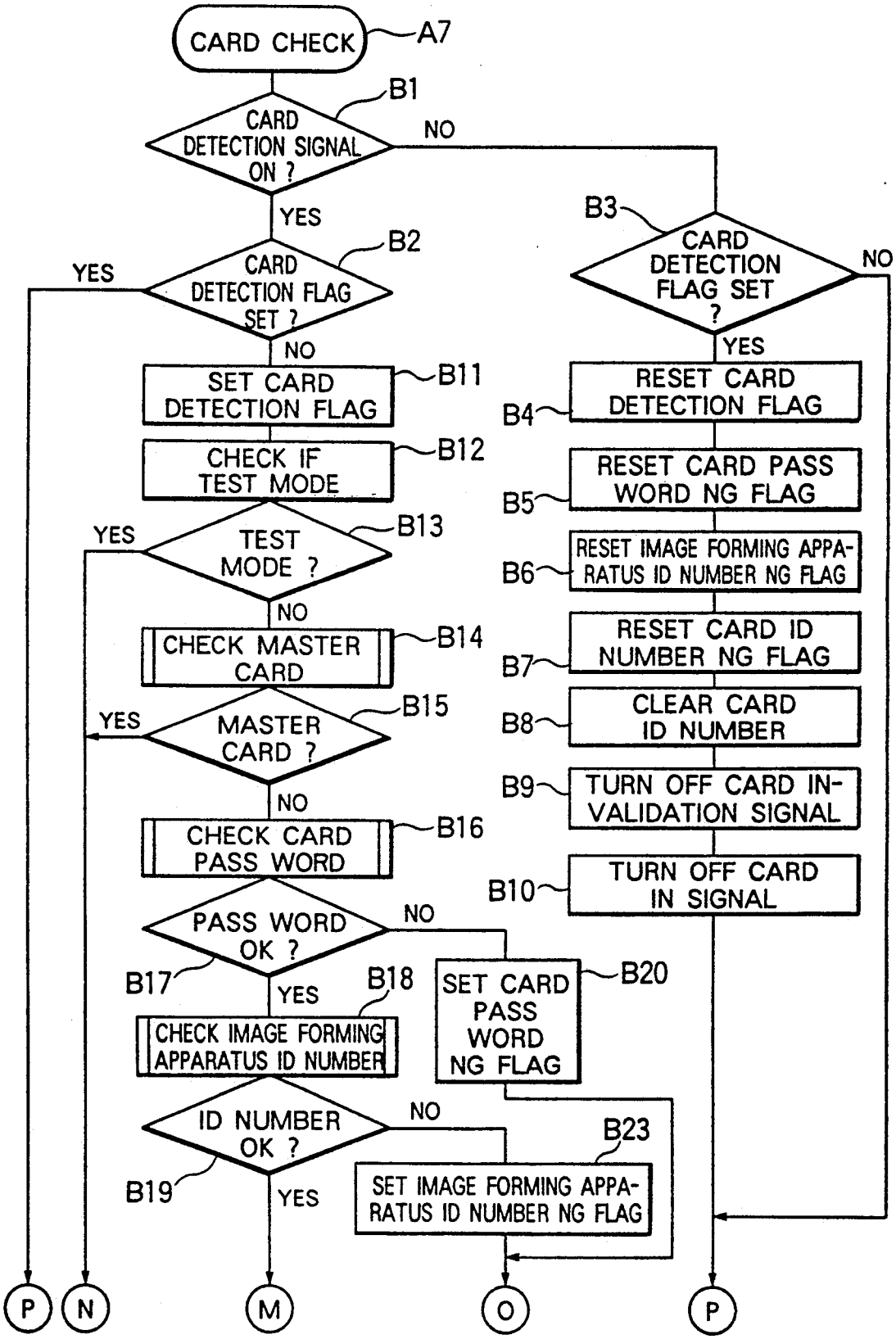
FIG. 7 is a flowchart of card check (detection)

First, operations of the second control means 50 will be explained, referring to FIG. 5 that is a flowchart of the second control means 50 and FIGS. 6 and 7 which represent flowcharts of card check.

First, when an image forming apparatus is supplied with power, the sequence advances to step Al and step A2, and then advances to step A3 after initializing a CPU of the second control means 50 and peripheral I/Os. At the step A3, the sequence stands by until REQ signals from the first control means 40 are inputted. After the REQ signals from the first control means 40 are received, namely, after data are sent from the first control means 40 through communication transmission means 60, the sequence advances to step A4 and the data are transferred to the second control means 50 as illustrated in a time chart shown in FIG. 4 (b). These data are initial data and, for example, image forming apparatus ID Nos., card ID Nos. which can use the image forming apparatus mentioned above, pass words, and designation of a counter that counts (which will be described in detail in the latter stage) are are sent in and they are stored in memory means 55. After communication processing for the initial data has been completed, the sequence advances to the next loop.

Figure 13:
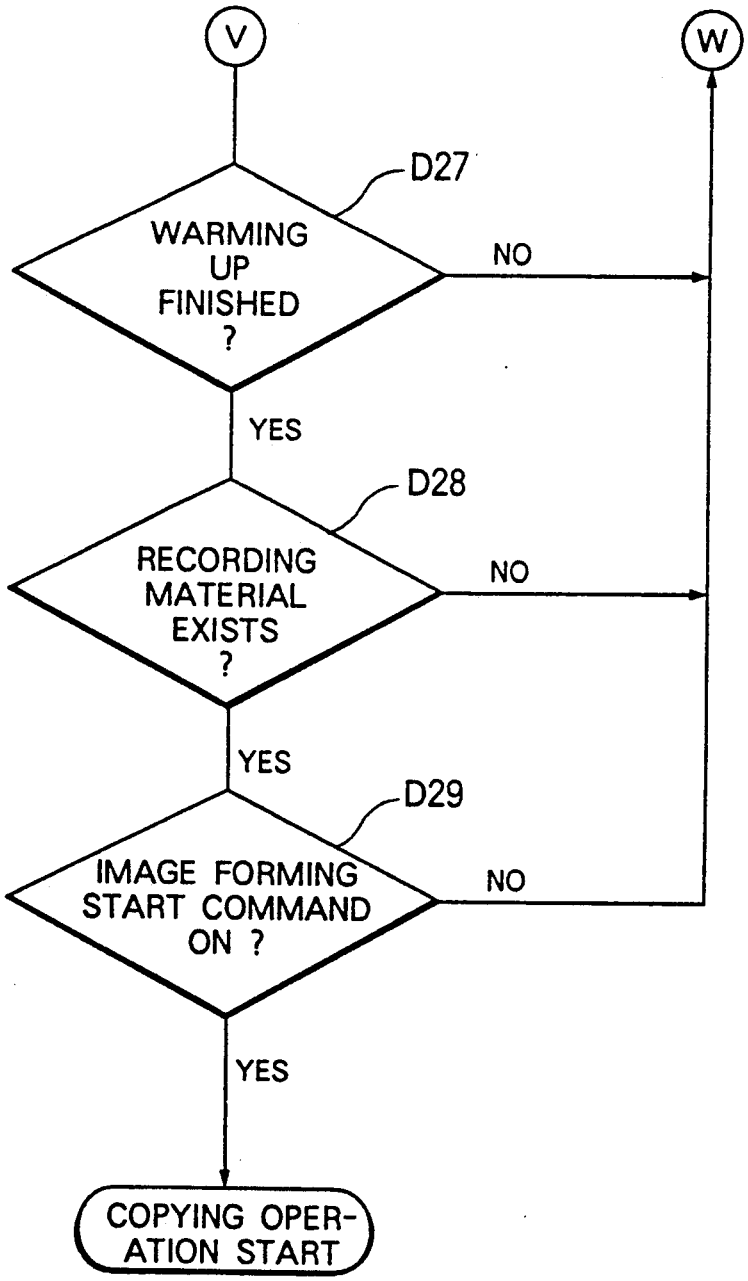
FIG. 13 is a flowchart up to copy start following FIG. 12.

In step A5 of the loop, communication processing for step A6 is made in the case of transmission of data from the first control means 40. The data conducted in this case include 'count mode start command', usable card ID Nos., image forming apparatus ID Nos., person ID Nos., recording sheet size and image forming mode which are sent when a 'card mode' shown in FIG. 13 which will be explained in the latter stage has been established. Usually, immediately after the power supply, idling of an image forming apparatus is conducted. Therefore, communication processing in the step A6 is skipped, and card check in the following step A7 which will be explained in detail in the latter stage is conducted.

After the card check in the step A7 has been conducted, determination is made in the step A8 to check whether the mode is a 'count mode' or not. Namely, when the sequence is 'count mode start command' due to the aforementioned communication processing, the sequence advances to the next step A9. If the mode is not 'count mode', on the contrary, the sequence returns to the aforementioned step A5.

In the step A9, determination is made whether the sequence is 'count pulse ON' or not. If the sequence is 'count pulse ON', the sequence advances to step A10 where determination is made whether 'count pulse ON flag' is set or not. When the 'count pulse ON flag' is set in the step A10, the sequence goes back to the aforementioned step A5. If the 'count pulse ON flag' is not set in the step A10, on the contrary, the 'count pulse ON flag' is set in the step A12 and count processing is conducted in step A13 and the sequence goes back to the aforementioned step A5. When the sequence is not 'count pulse ON' in step A9, on the other hand, the sequence advances to step A11 where 'count pulse ON flag' is reset, and the sequence returns to the aforementioned step A5.

Count processing in the step A13, in this case, is to count corresponding counter in card 30 based on designation of corresponding counter by person ID No., card ID No. in card 30, and by transfer sheet size which have been communication-processed in the aforementioned A6, and to count, according to, generation of count pulses, the number of copying to memory unit 452 or memory unit 453 provided on memory means 45 of the first control means 40 based on card ID No. transferred in step D12 which will be described later.

Next, 'card check' in the step A7 which is conducted by the second control means 50 will be explained, referring to FIGS. 6 and 7 which represent flowcharts of card check.

After entering the step of card check in step A7, the sequence advances to step B1 and determination is made whether 'card detection signal' is ON or not. In an occasion where the 'card detection signal' is ON, detection means 58 detects that the card 30 has been attached when one end of input/output terminal of card 30 is grounded, for example, and the card 30 is connected electrically with the input/output terminal of the second control means 50. When card detection signal is ON in step B1, the sequence advances to step B2. If the card signal is not ON, on the contrary, the sequence advances to step B3. In the step B3, determination is made whether the 'card detection flag' is set or not, and if it is set, 'card detection flag', 'card pass word NG flag', image forming apparatus ID No. flag and card ID No. flag are reset in steps B4 through B10, card ID No. is cleared, card invalidation signal and card IN signal are caused to be OFF, and the sequence returns to the aforementioned step A8. If they are not set in the step B3, on the contrary, the sequence goes back to the aforementioned step A8.

In the step B2, on the other hand, determination is made whether 'card detection flag' is set or not, and if it is set, the sequence returns to the aforementioned step A8, while when it is not set, the sequence advances to step B11. In the step B11, 'card detection flag' is set and the sequence advances to steps B12 and B13. In the steps B12 and B13, determination is made whether the mode is a test mode or not, and if it is not a test mode, the sequence advances to steps B14 and B15, while if is a test mode, the sequence advances to step B29. The test mode in this case means that information telling the test mode in communication-processing in step A4 is transmitted to the second control means through a specific method carried out in the case of power supply. This test mode is set only when a serviceman initializes or adjusts an image forming apparatus or when items stored in card 30 are changed.

In the steps B14 and B15, the card attached is checked whether it is a master card or not, and when it is not a master card, the sequence advances to steps B16 and B17, while if it is a master card, the sequence advances to step B29. The master card is one with which a serviceman can operate any image forming apparatuses despite the image forming apparatus ID No.

In the steps B16 and B17, the pass word is checked, and when the pass word agrees, the sequence advances to steps B18 and B19, while if it is wrong, 'card pass word NG flag' is set in the step B20 and the sequence advances to step B28. The pass word in this case means a comparison between pass word stored in card 30 attached on the acceptor 29 and pass word stored in the image forming apparatus. In other words, it is a step to determine whether a prescribed form in the attached card is a predetermined one or not.

In the steps B18 and B19, image forming apparatus ID No. is checked, and when the image forming apparatus ID No. agrees, the sequence advances to steps B21 and B22, while if the image forming apparatus ID No. does not agree, the 'image forming apparatus ID No. flag' is set in the step B23 and the sequence advances to step B28. The check of the image forming apparatus ID No., in this case, is conducted to determine whether or not even only one of all image forming apparatus ID Nos. stored in the card 30 agrees with the image forming apparatus ID No. stored in the image forming apparatus. Namely, in the aforementioned step A4 preceding step B18, image forming apparatus ID No. stored in memory means 45 of the first control means 40 is transferred to the second control means 50 through communication transmission means 60 and then stored in memory means 55. In the step B18, plural image forming apparatus ID Nos. which are stored in card ID No. memory means 32 and are usable with card 30 are read by selection unit 541 successively and are determined, at comparison unit 543 of determination means 54, whether they agree with image forming apparatus ID No. stored in the aforementioned memory means 55. This determination is made for all the image forming apparatus ID Nos. stored in card 30.

In steps B21 and B22, card ID No. check mode is determined whether it is set or not, and if it is set, the sequence advances to steps B24 and B25, while when it is not set, the sequence advances to step B26. In the steps B24 and B25, card ID Nos. are checked, and when the card ID Nos. agree, the sequence advances to step B26, while if the card ID Nos. do not agree, card ID No. NG flag is set in the step B27 and the sequence advances to step B28. This card ID No. check mode is a confirmation mode in which ID No. of card itself is compared with card ID No. which is stored in an image forming apparatus and is usable on the image forming apparatus. This mode is detected whether or not it is set in advance by means of input means 46, a determination switch and others all provided on the image forming apparatus, and it is transferred from the first control means 40 to the second control means 50 through communication transmission means 60 in the course of initial communication processing of the aforementioned step A4, to be stored in memory means 55. This card ID No. check is conducted similarly to the aforementioned image forming apparatus ID No. check.

In the step B26, card 30 ID Nos. stored in card 30 are read by read/write means 51 of the second control means and stored in memory means 55, and then are transferred to a memory unit of the control means 50 in the step D12, thus card invalidation signals are caused to be OFF in the step B29, and the sequence advances to step B30. On the other hand, when pass words in steps B17, B19 and B25, image forming apparatus ID Nos. and card ID Nos. do not agree in the check thereof, card invalidation signals are caused to be ON in the step B28 and the sequence advances to step B30. In the step B30, card IN signals are caused to be ON and the sequence goes back to step A8 and thus the card check is completed. Incidentally, card invalidation signals and card IN signals are transferred from the second control means 50 to the first control means 40 by means of exclusive card invalidation transmission means 63 and card IN transmission means 62 respectively as stated above.

Figure 8:
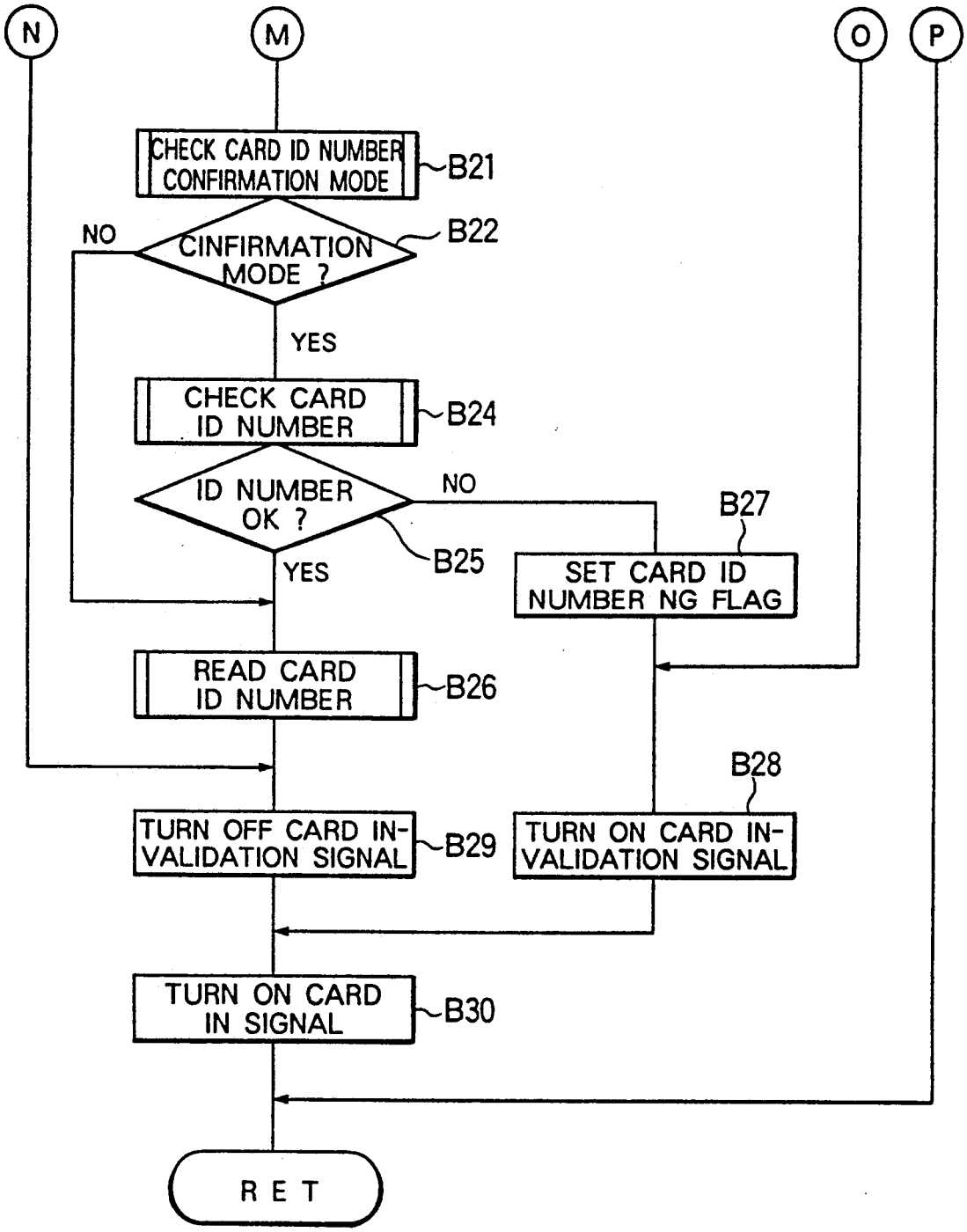
FIG. 8 is a flowchart of card check (confirmation)
Figure 9:
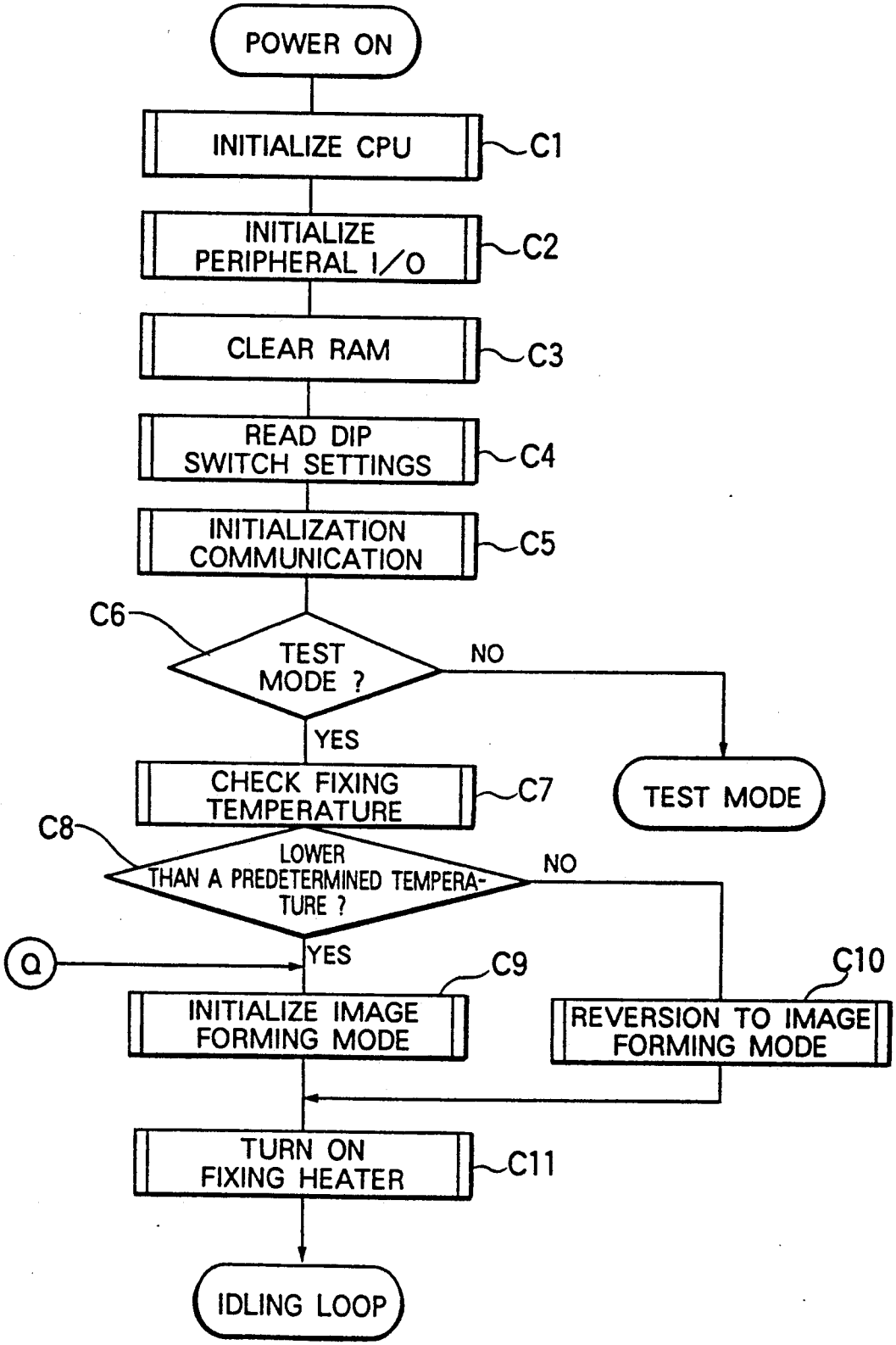
FIG. 9 is a flowchart of sequence control by means of the first control means.
Figure 10:
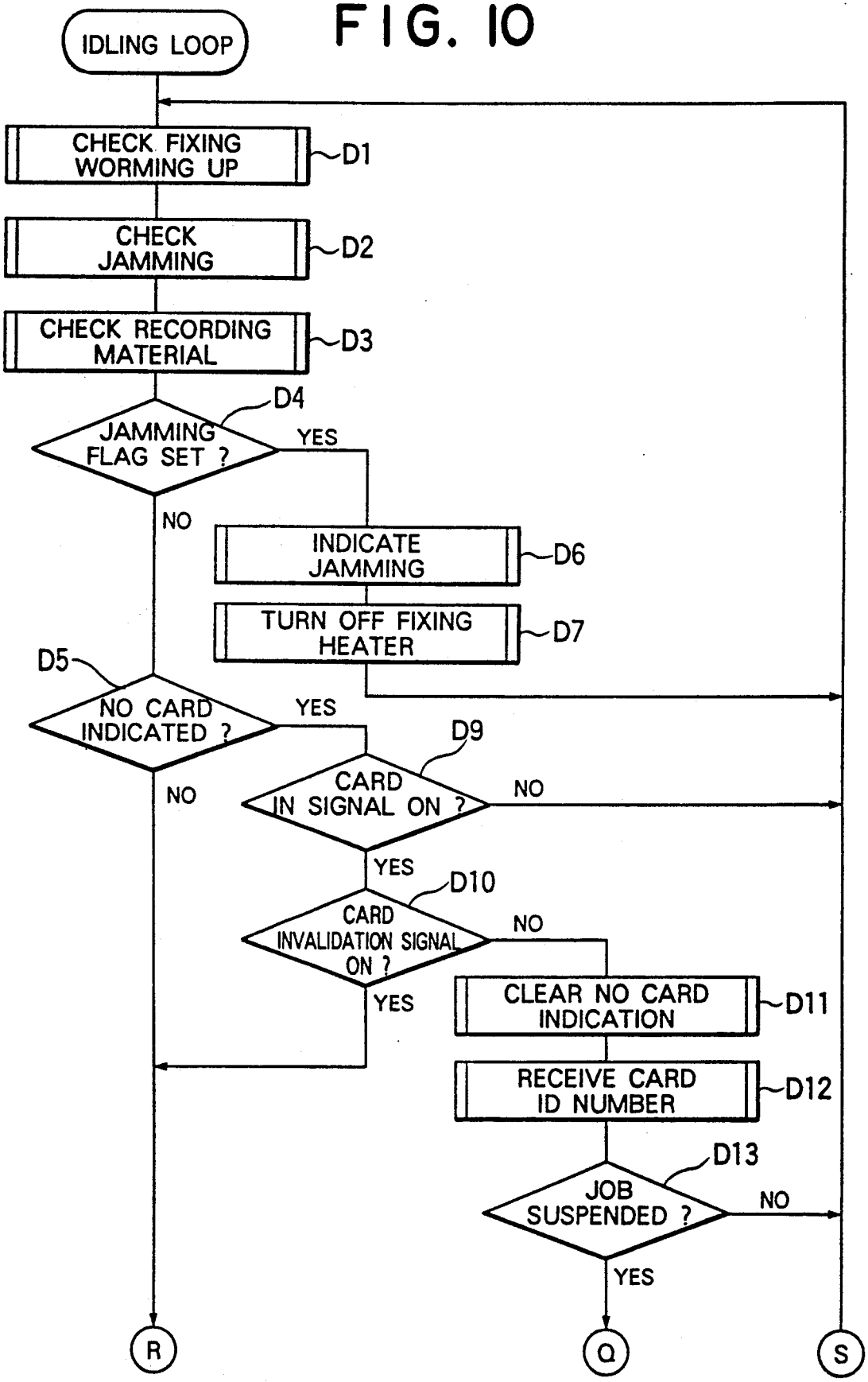
FIG. 10 is a flowchart of a idling loop following FIG. 9.
Figure 11:
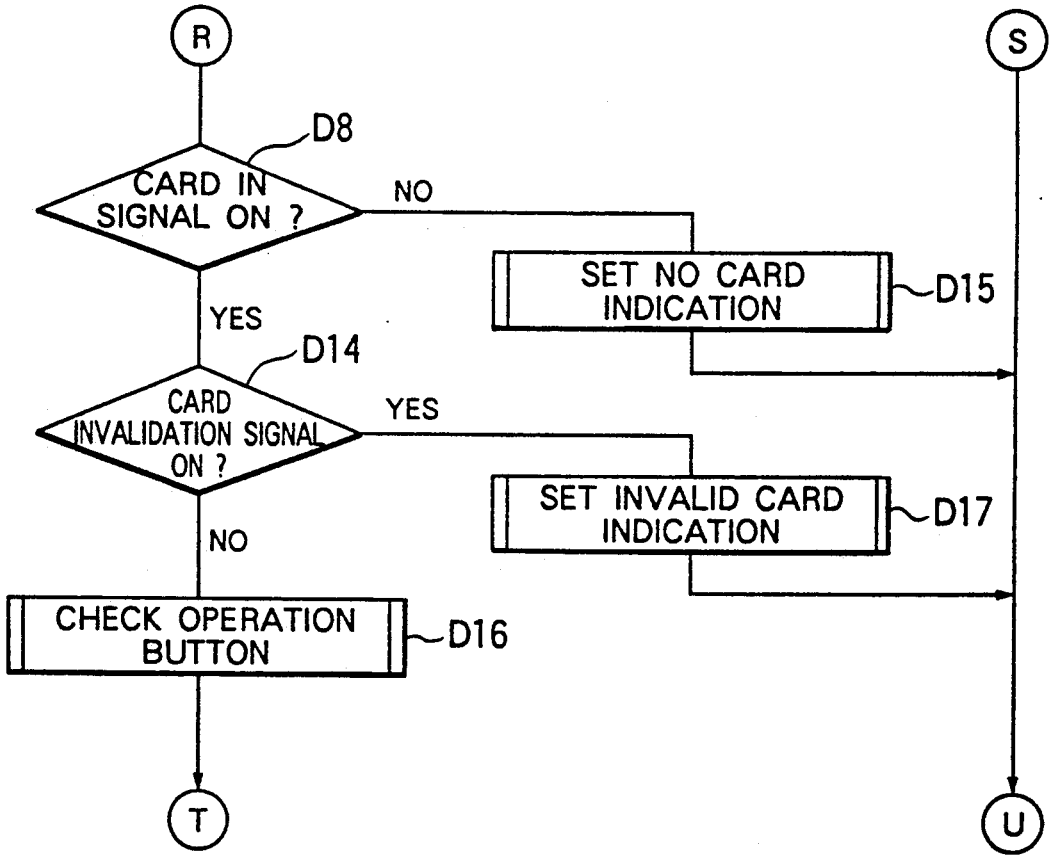
FIG. 11 is a flowchart including detection of memory card IN signal following FIG. 10.
Figure 12:
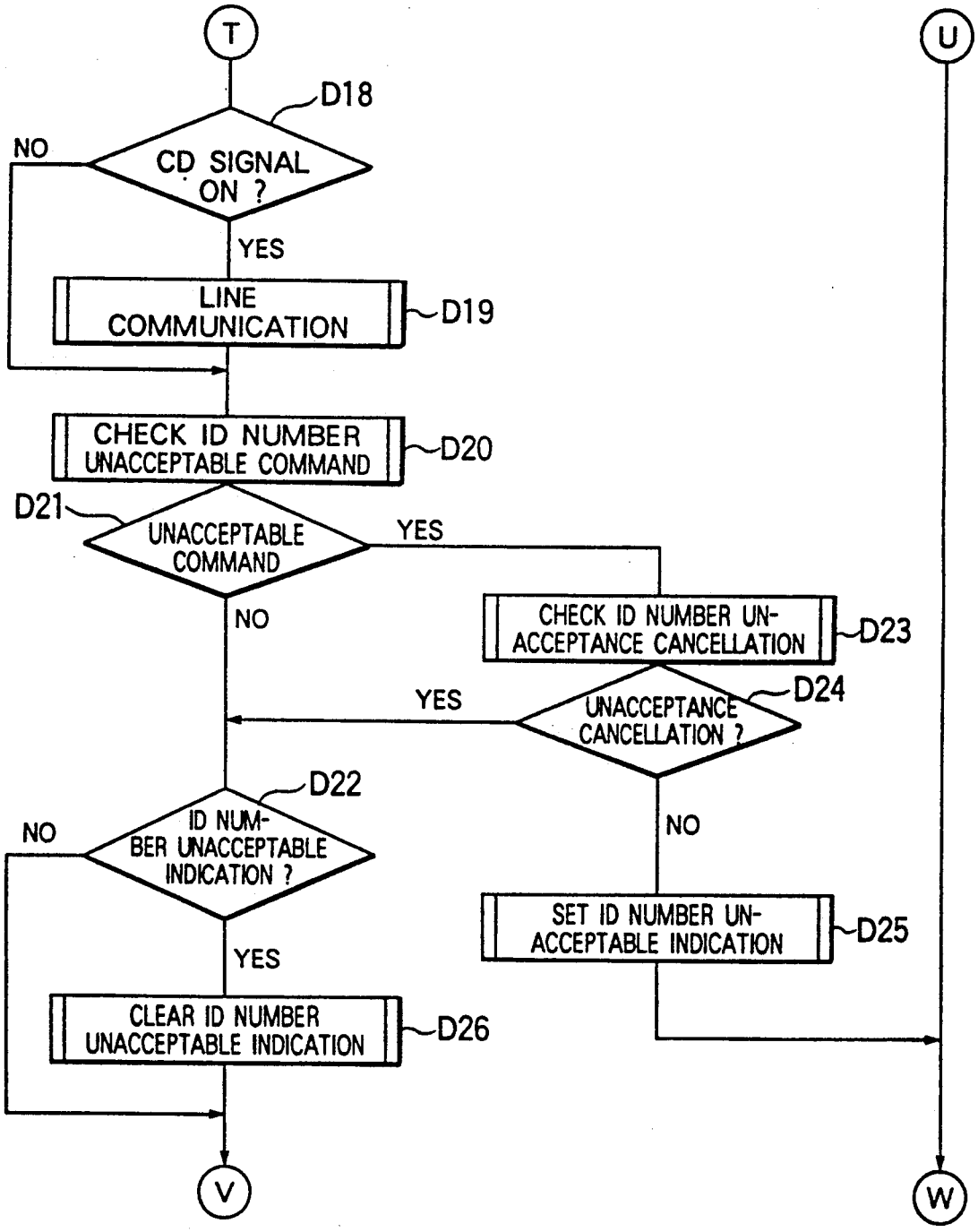
FIG. 12 is a flowchart including confirmation of pass word following FIG. 11.

Next, operations of the first control means 40 will be explained as follows, referring to FIG. 8 that is a flowchart of the first control means 40 and FIGS. 9-12 which represent flowcharts of idling loops.

First, when power source is turned on for an image forming apparatus, a CPU is initialized in step C1, peripheral I/0 is initialized in step C2, RAM is cleared in step C3 and dip switches are read in step C4, and thus the sequence advances to step C5. In the step C5, initialization communication (corresponding to step A4) is conducted for transferring initial data to the second control means 50, and the sequence advances to step C6. In the step C6, a mode is checked whether it is a test mode or not, and if it is a test mode, the sequence advances to the test mode, while when it is not a test mode, the sequence advances to steps C7 and C8. This test mode is set only when servicemen or the like initialize or adjust an image forming apparatus or items stored in card 30 are changed, and, for example, the test mode can be set by pressing simultaneously all keys of a tenkey on an operation panel.

In the steps C7 and C8, temperature of fixing means 24 is checked whether it is a predetermined temperature or not, and when the temperature is lower than the predetermined temperature, image forming mode is initialized in step C9, while if it is not lower than the predetermined temperature, the image forming mode is reversed in step C10, and the sequence advances to step C11 in both cases mentioned above. In the step 11, a fixing heater which is the heat source for the fixing means 24 is turned on, and the sequence advances to the next idling loop.

After entering an idling loop, warm-up of the fixing means 24 is checked in step D1, jamming on a conveyance path for a transfer material is checked in step D2, and sheet-feeding cassette 18 is checked, in step D3, whether or not it is mounted on an apparatus properly or whether it is loaded with transfer materials, and the sequence to step D4. In the step D4, jam flag is checked whether it is set or not, and if it is not set, the sequence advances to step D5, while when it is set, display means 48 indicates jamming in step D6 and a fixing heater is turned off in step D7, and the sequence goes back to the aforementioned step D1.

In the step D5, the display means 48 checks whether 'no card' is displayed (which will be described later) on a display portion (not shown) provided on the operation panel or not, and when it is not displayed, the sequence advances to step D8, while if it is displayed, the sequence advances to step D9. In the step D9, card IN signals are checked whether they are ON (step B30) or not, and when they are ON, the sequence advances to step D10, while if they are not ON, the sequence goes back to the aforementioned step D1. In the step D10, card invalidation signals are checked whether they are 0N (step B28) or not (step B29), and when they are ON, the sequence advances to step D8, while if they are not ON, indication of 'no card' is cleared in the step D11, card ID No. is received (from the second control means 50 through communication transmission means 60) in the step D12, and the sequence advances to step D13. In the step D13, a job is checked whether it is interrupted or not, and when it is interrupted, the sequence goes back to the aforementioned step D1, while if it is not interrupted, the sequence returns to the aforementioned step C9.

In the step D8, card IN signals are checked whether they are ON (step B30) or not, and when they are ON, the sequence advances to step D14. Namely, after detection means 58 detects that card 30 has been attached, determination is made by means of card IN signals inputted in determination means 44 through card IN transmission means 62. On the contrary, if card IN signals are not ON, display of 'no card' is made in the step D15 and the sequence goes back to the aforementioned step D1. Namely, when detection means 57 detects that no card 30 has been attached, card IN signals are not caused to be 0N and thereby no signal is sent to card IN transmission means 62. Therefore, determination that there are no card IN signals is made in determination unit 44 and thereby display means 48 indicates on a display portion of an operation panel the wording of, for example, 'Set the card'.

In the step D14, card invalidation signals are checked whether they are ON (step B28) or not (step B29), and when they are not ON, the sequence advances to step D16, while when they are ON, card invalidation indication is set in step D17 and the sequence advances to the aforementioned step D1. The card invalidation signals are the signals which are inputted from determination means 54 into determination means 44 through card invalidation transmission means 63 as described before. Incidentally, the aforementioned card invalidation display is indicated by display means 48 on the aforementioned display portion, and its wording is, for example, 'This card is not usable.'

In the step D16, each operation button on an unillustrated panel is checked and processed according to respective subroutine. After various kinds of operation buttons have been checked, the sequence advances to step D18. Steps D18 through D26 form a flowchart related to the occasion where an image forming apparatus in the present example is connected to a host computer through telecommunication lines. After steps D18 through D26 are completed, the sequence advances to step D27.

In the step D27, warm-up of fixing means 24 is checked whether it has been completed or not, and when it is completed, the sequence advances to step D28, while if it is not completed, the sequence goes back to the aforementioned step D1. In the step D28, sheet-feeding cassette 18 is checked whether it is loaded with transfer materials P or not, and when it is loaded, the sequence advances to step D29, while if it is not loaded, the sequence goes back to the aforementioned step D1.

In the step D29, image forming start command is checked whether it is ON or not, and when it is ON, the sequence enters a routine of copy start, while when it is not ON, the sequence returns to the aforementioned step D1. This image forming start command is caused to be ON (input) through input means 46 when a copy button provided on an operation panel keeps being pressed.

Next, a flow of operations after the copy button is pressed, namely, a flowchart after the start of copying will referring to FIGS. 13–17. Since it is the same as the copy process mentioned above, the flowchart will be explained briefly.

When copy operation (copy start mode) is started by pressing a copy button, a main motor and high voltage power supply are turned on, and the first sheet-feeding (sheet-feeding roller 19) is caused to be ON after copy count and sheet-discharge count are reset. In an image forming apparatus of the present example, however, the relevant counter (for example, those inputted by various buttons provided on an operation panel for card ID No., department ID No., person ID No., transfer material size No., and image forming mode, and designated by a counter designation means through input means 46) established before the start of copying, is transferred from the first control means 40 to the second control means 50 during the non-job period before the first sheet-feeding (sheet-feeding roller 19) is caused to be ON.

Figure 14:
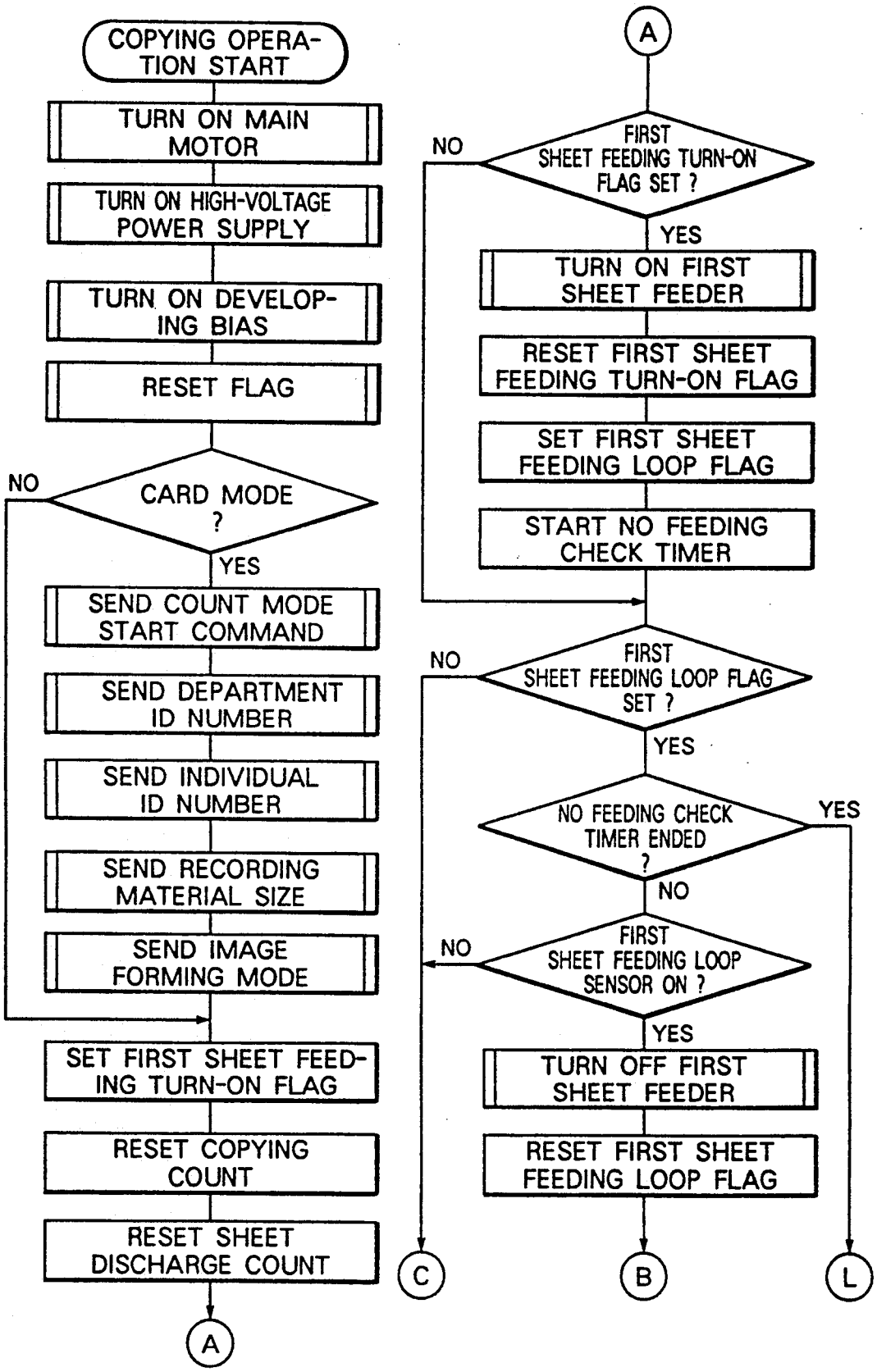
FIG. 14 is a flowchart from copy start following FIG. 13.
Figure 15:
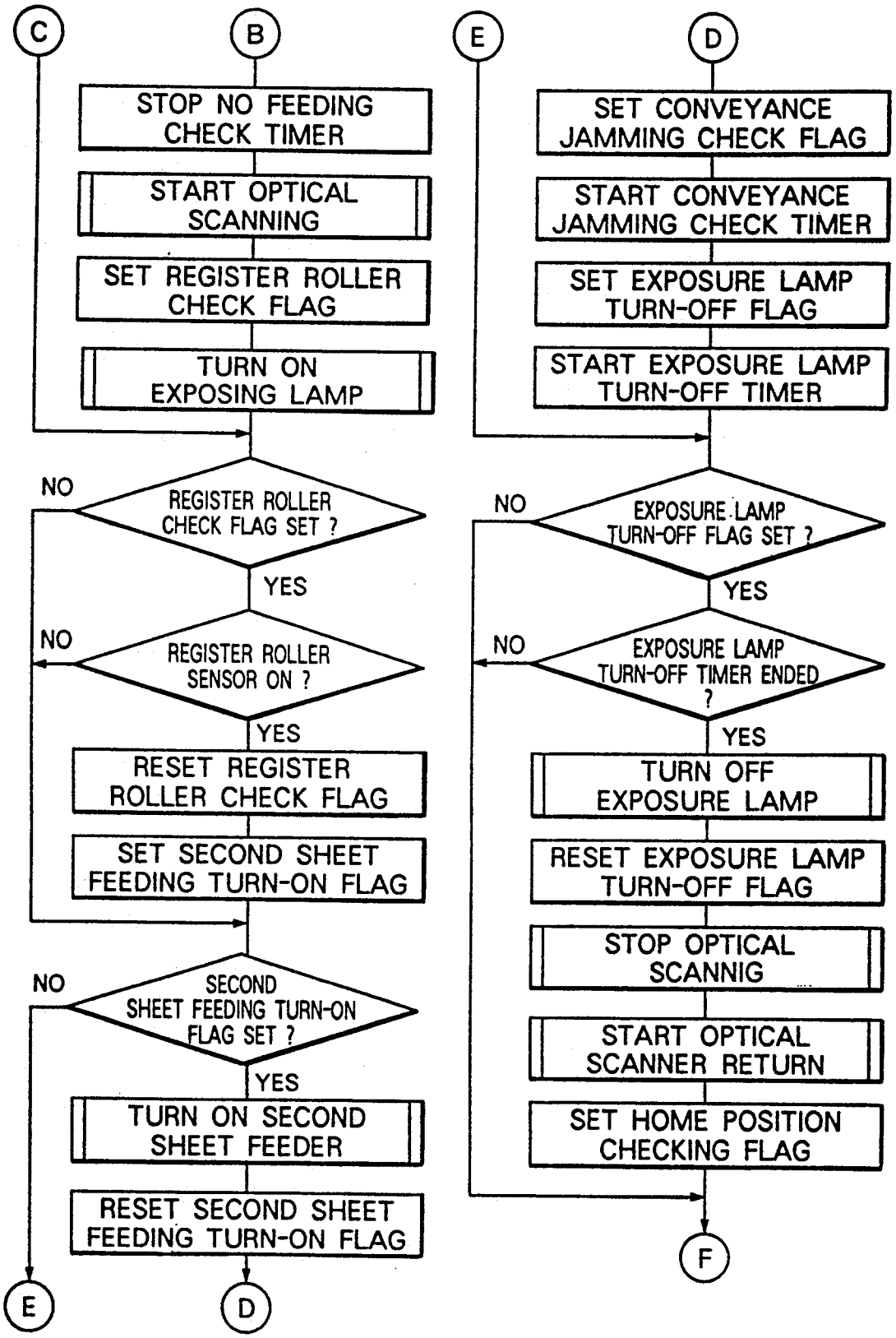
FIG. 15 is a flowchart mainly for exposure and the first sheet feeding following FIG. 14.
Figure 16:
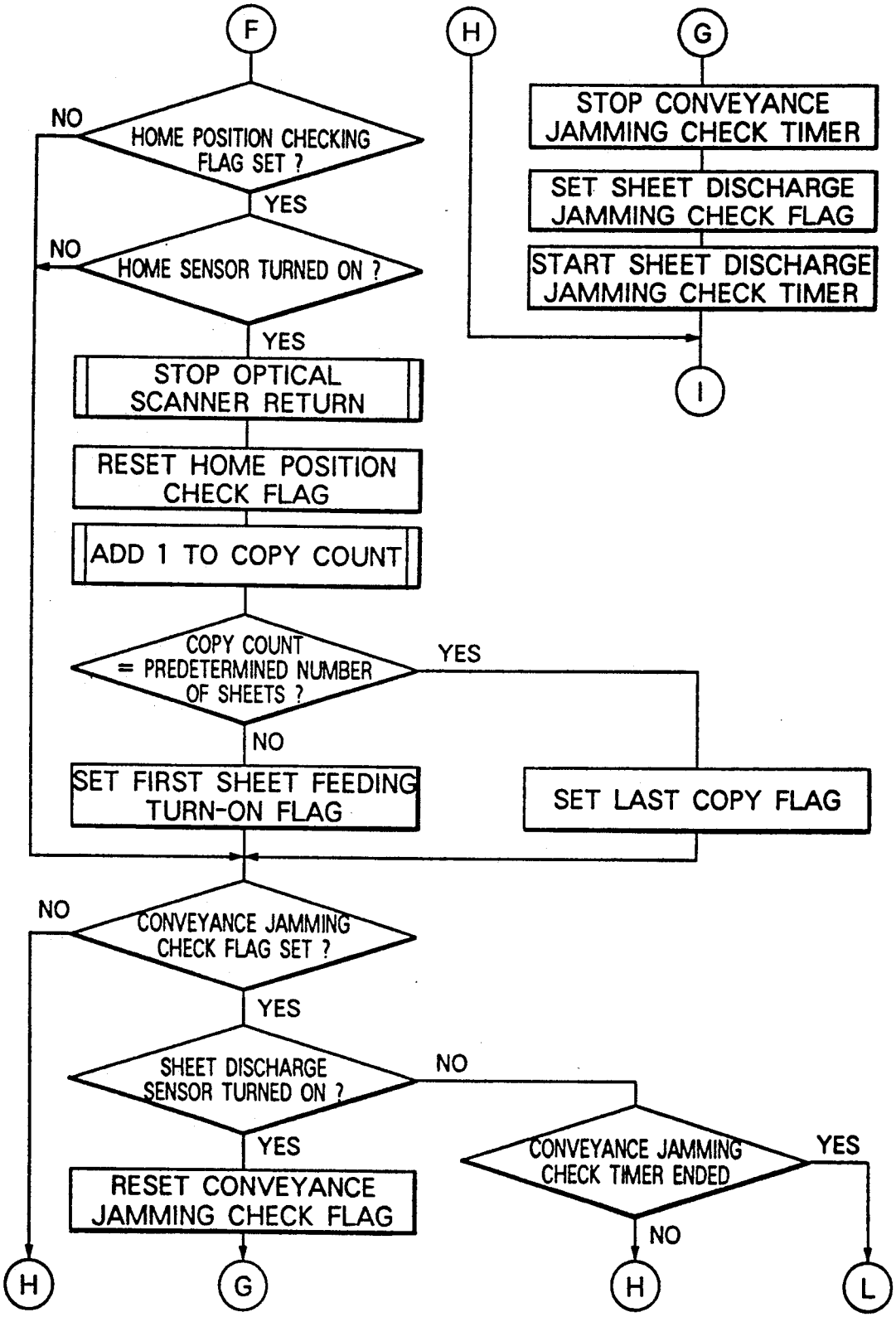
FIG. 16 is a flowchart including jamming detection following FIG. 15.
Figure 17:
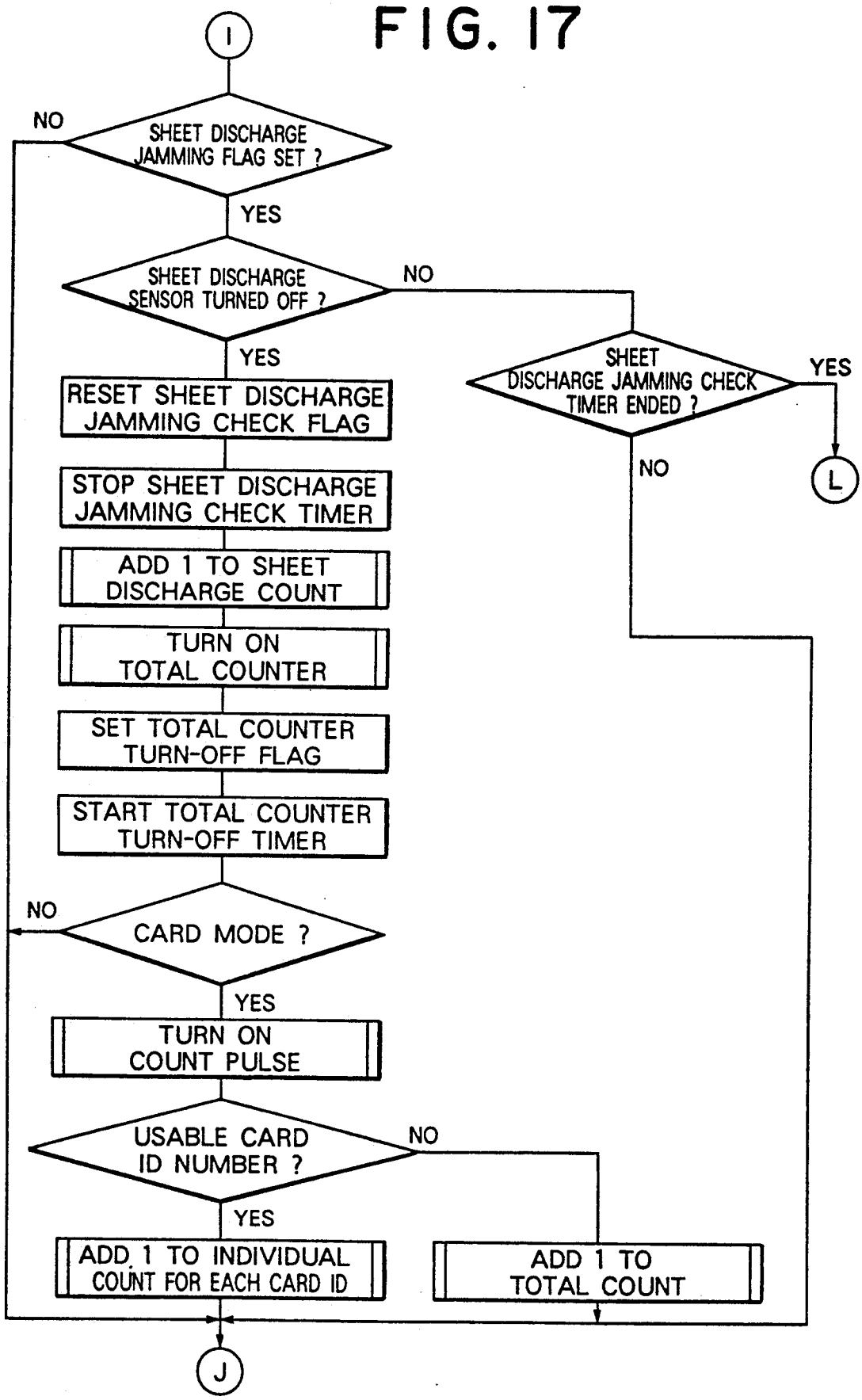
FIG. 17 is a flowchart including detection of sheet discharge sensor following FIG. 16.
Figure 18:
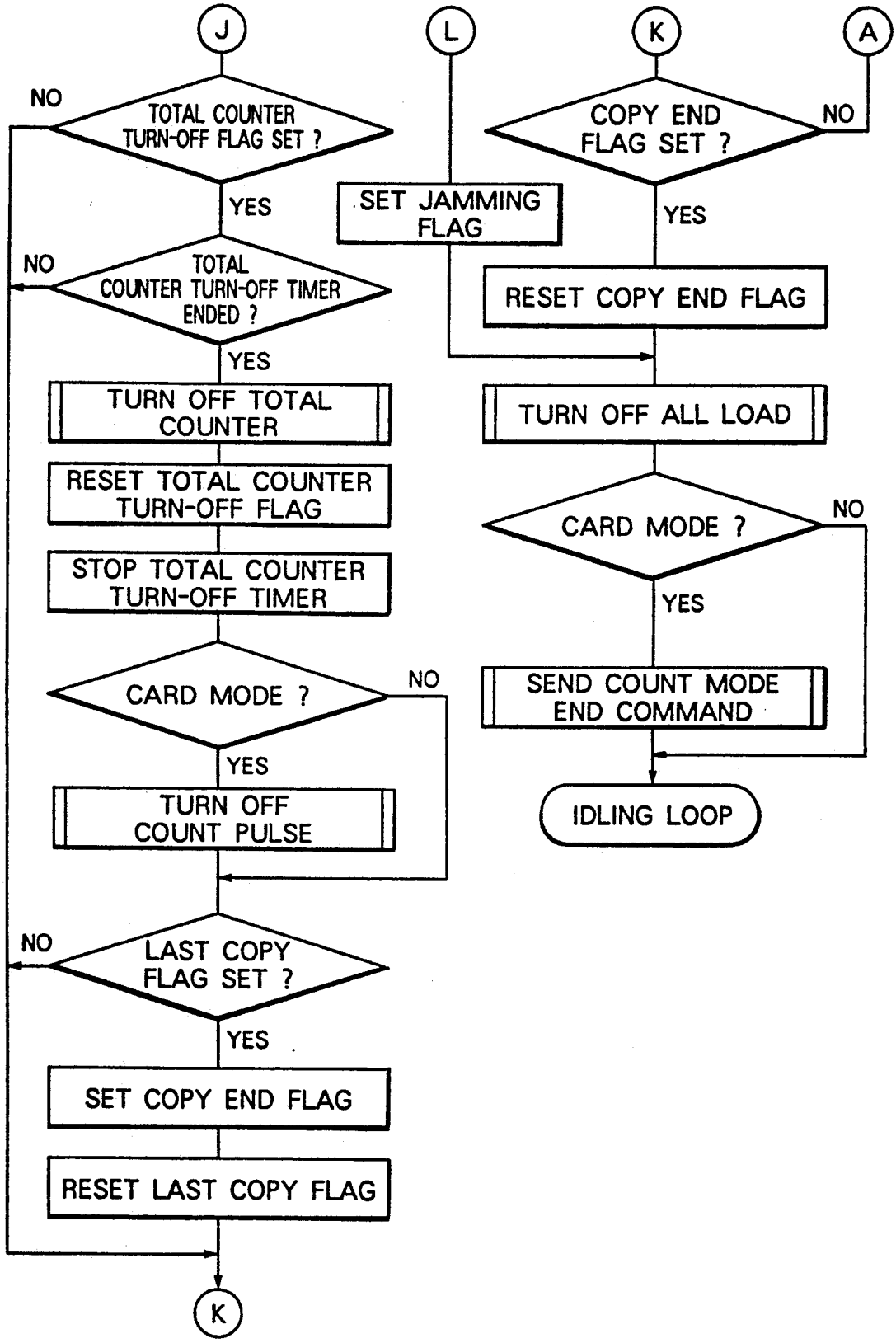
FIG. 18 is a flowchart up to returning to an idling loop following FIG. 17.

After the first sheet-feeding is caused to be OFF, the sequence moves to a flow shown in FIG. 14, and after a document is scanned optically, the second sheet-feeding (timing roller 20) is caused to be ON. After the optical scanning is completed, the scanning optical system starts returning to its home position. In FIG. 15, the optical system stops returning, 'copy count+1' is caused, this value is indicated on a display of the image forming apparatus and is compared with the copy quantity set, and a sheet-discharge sensor is caused to be ON. After that, a conveyance jam check timer stops, a sheet-discharge jam check timer starts operating and the sequence moves to a flow shown in FIG. 16. After the sheet-discharge sensor is caused to be OFF, 'sheet-discharge count+1' is caused, and a total counter is caused to be ON. Then, count pulses are caused to be ON, and are transferred as a pulse waveform from count pulse generating means 43 of the first control means 40 to count pulse detection means 53 of the second control means 50 through count pulse transmission means 61 during the period up to OFF of a count pulse shown in FIG. 17. The count pulses thus transferred are counted into a counter designated previously and also counted into count memory unit 45 for each card ID No. provided on memory unit 45 based on card ID No. that is transmitted in step D12. In this case, when there is no count memory unit 45 for each card ID No. corresponding to transmitted card ID No., there is provided count memory unit 453 that stores collectively, and counting is made collectively into the count memory unit 453.

When a copy end flag is set, ALL OFF of a load and transmission of a count mode end command are conducted, and then the sequence enters an idling loop. When a copy end flag is not set, on the other hand, the sequence is restored to a flow shown in FIG. 13-A, and copy control is repeated. Since there is no change in the relevant counter, in this case, count pulses only are transferred during repetition of copying, the relevant counter is counted into memory card 3 based on the stored counter designation, each time one copy is completed.

As described above, it is possible to eliminate waste and collectively control the copy quantity relating to a card which is not used so frequently, in the case of a centralized control of copy quantity. Namely, the number of copying operations concerning a card that is used frequently is memorized into an exclusive image forming frequency memory unit, while the number of copying operations concerning each card that is not used frequently is collectively memorized. Thus, it is possible to reduce the capacity of memory means, thereby to reduce the cost, and make the centralized control easy, which are advantages.

What is claimed is:

1. A counting device for counting a number of image forming operations of an image forming apparatus, said counting device comprising:

registering means for registering a plurality of identifications codes;

comparing means for comparing an identification code stored in a portable storing means with said plurality of identification codes registered in said registering means;

first memory means for counting a number of image forming operations of said image forming apparatus when said comparing means matches said identification codes stores in said portable storing means with at least one of said plurality of identification codes registered in said registering means; and second memory means for counting a number of image forming operations of said image forming apparatus when said comparing means does not match said identification codes stored in said portable storing means with any of said plurality of identification codes registered in said registering means.

2. The counting device of claim 1, wherein said portable storing means comprises a card having a non-volatile memory.

3. The counting device of claim 1, wherein said image forming apparatus comprises validity determination means for determining in validity of said identification code stored in said portable storing means, said validity determination means enabling said image forming apparatus to perform image forming operations when said identification code is determined to be valid, and wherein said counting device comprises means for being activated responsive to said validity determination means enabling said image forming apparatus.

* * * * *